US005852832A

United States Patent [19]

Voigt et al.

[11] Patent Number: 5,852,832

[45] Date of Patent: Dec. 29, 1998

[54] PORTABLE TOILET SEAT

[76] Inventors: Tricia Anne Voigt; Trina Conant, both of 6050 Kelton Ave., LaMesa, Calif. 91942

[21] Appl. No.: 915,391

[22] Filed: Aug. 20, 1997

[51] Int. Cl.[6] ..... A47K 13/00

[52] U.S. Cl. ..... 4/237; 4/484

[58] Field of Search ..... 4/237, 239, 460, 4/483, 484, 449, 479

[56] References Cited

U.S. PATENT DOCUMENTS

| | | | |
|---|---|---|---|
| 703,690 | 7/1902 | Young | 4/237 X |
| 2,443,068 | 6/1948 | Dahle | 4/239 |
| 2,457,726 | 12/1948 | Richards | 4/239 |
| 2,804,121 | 8/1957 | Singleton | 4/483 |
| 4,633,536 | 1/1987 | Tribble-DuBose | 4/449 X |
| 5,161,263 | 11/1992 | Geneve et al. | 4/239 X |

*Primary Examiner*—Charles E. Phillips
*Attorney, Agent, or Firm*—Goldstein & Canino

[57] ABSTRACT

A portable toilet seat comprising a horseshoe shaped base having an inner surface and outer surface, top surface and bottom surface, a front region and an open center. A plurality of telescoping legs extend downward from the bottom surface and retract into appropriately sized recesses which are also disposed about the bottom surface of the base. A lip extends around the perimeter of the inner surface for engaging a deformable waste receptacle such as a bag. The portable toilet bowl is used by retracting the telescoping legs and placing the base on top of a standard toilet bowl to prevent unsanitary bodily contact therewith. When a standard toilet bowl is unavailable, the plurality of legs may be extended to support the base above a surface such as the ground, thus allowing a user to deposit human waste through the center upon said surface, or into the deformable waste receptacle is so desired.

5 Claims, 3 Drawing Sheets

PORTABLE TOILET SEAT

BACKGROUND OF THE INVENTION

The invention relates to a portable toilet seat. More particularly, the invention is a portable toilet seat that can be used in conjunction with a public toilet or as a free standing toilet.

More often than not, the facilities available in public rest-rooms are unsanitary. Unfortunately, the situation often arises in which one has no other alternative but to use a public rest-rooms. Disposable toilet seat covers have been developed to aid people in maintaining good hygiene when using public facilities. However, there are many disadvantages to these disposable covers. Typically, such covers are available from dispensers and placed over the toilet seat. Besides the situation in which these dispensers are empty, the covers are not reliable since they do tear aid rupture. Further, these covers are difficult to keep in position and can stick to the user's skin. Consequently, many people choose not to use the disposable covers because of their inconvenience.

Another situation in which a portable toilet seat can be utilized is with young children who are being toilet trained. A portable toilet seat would allow a child to utilize the seat at any time. Most of the prior art only discloses seats that are used in conjunction with a standard toilet. However, many situations arise in which a toilet is needed but not available. One such situation is with young children who are being toilet trained. A free standing portable toilet seat could be set up at anytime and anywhere for emergencies. Such a seat would also provide a sanitary solution when the only facility available is a public rest-rooms.

U.S. Pat. No. 5,267,355 to Landman discloses a portable toilet seat that is mounted on a standard toilet seat.

U.S. Pat. No. 5,005,223 to Greenwood discloses a foldable toilet seat that is specifically designed for use with children.

U.S. Pat. No. 5,230,105 to Watson discloses a toilet seat and stand for wilderness camping that needs to be assembles for use and disassembled for storage.

While these units may be suitable for the particular purpose employed, or for general use, they would not be as suitable for the purposes of the present invention as disclosed hereafter.

SUMMARY OF THE INVENTION

It is an object of the invention to produce a portable toilet seat.

It is a further object of the invention to produce a portable toilet seat that can be used in conjunction with existing toilets. The portable seat is placed over an existing public seat, thus creating a sanitary means for one to use the public facility.

It is a further object of the invention to produce a portable toilet seat having foldable legs extending from the bottom of the seat. These legs enable one to use the portable seat as a free standing toilet. The seat also has a ledge along the bottom of the seat on which a bag attaches. The bag allows for easy and clean disposal of waste.

It is a still further object of the invention to produce a portable toilet seat in which the top of the seat is covered with a soft cushion-like material to provide comfort to a user.

It is a still further object of the invention to produce a portable toilet seat that easily folds up into a small compact unit. When folded the seat takes up little space and can easily stored. Further assembly of the seat is as simple as folding and unfolding the seat.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1A:
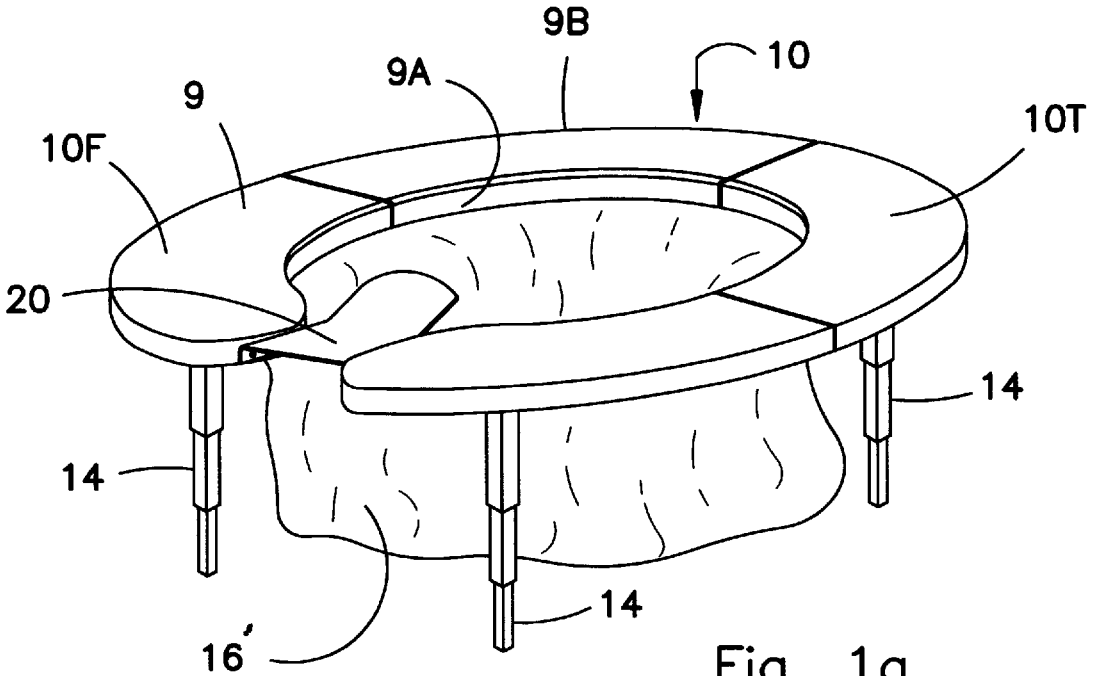
FIG. 1*a* is a diagrammatic perspective view of a portable toilet seat with telescoping legs extended and a deformable waste receptacle attached thereto.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the portable toilet seat. The words "proximal end" and "distal end" refer, respectively, to ends of an object nearer to and further from the operator of the object when the object is used in a normal fashion or as is described in the specification.

Figure 1B:
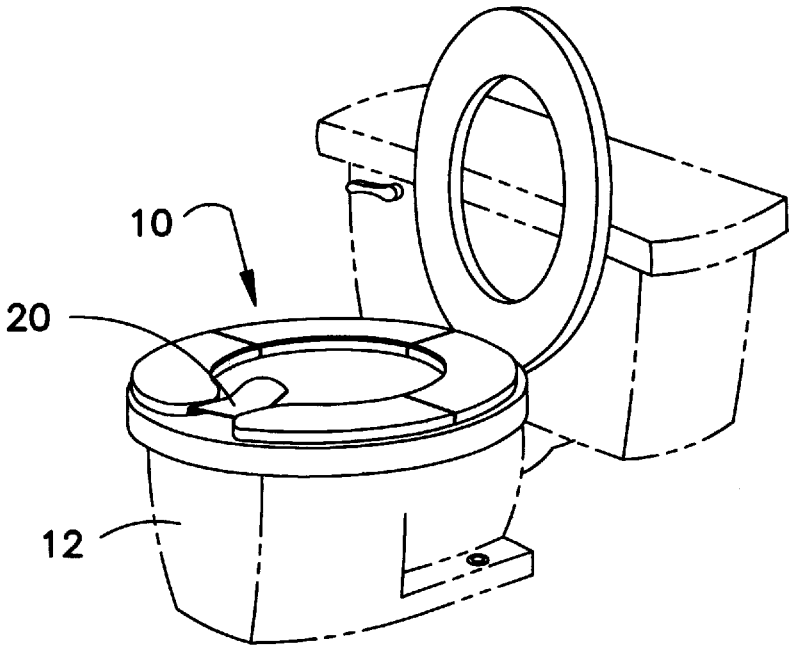
FIG. 1*b* is a diagrammatic perspective view of the portable toilet seat with the telescoping legs retracted, placed upon a toilet bowl.

FIG. 1*a* illustrates a portable toilet seat 10. The portable toilet seat 10 of the instant invention is multi-functional in that it may serve as a sanitary barrier to place on top of public toilet bowls 12 when contact therewith is to be avoided, as seen in FIG. 1*b,* or may be used in a "free-standing" mode when a toilet bowl 12 is unavailable, as seen in FIG. 1*a.* The instant invention is especially suited for infant potty training, but may also be employed by adults if so desired.

The portable toilet seat 10 comprises a horseshoe shaped base 9 having an inner surface 9A and outer surface 9B, top surface 9T and a bottom surface 9B, a front region 9F and an open center 9C. A plurality of telescoping legs 14 extend downward from the bottom surface 10B, as seen in FIG. 1*a.* Accordingly, the portable toilet seat 10 may be placed upon a surface when no toilet bowl 12 is proximal, the extended telescoping legs 14 functioning to support the base 9 above said surface. An individual may then sit on top of the base 9, and excrete human waste through the open center 9C thereof. A lip 16 extends downward about the perimeter of the inner surface 9A, for engaging a deformable waste receptacle 16 such as a bag or a pouch. As seen in FIG. 1*a,* once the waste receptacle 16 is secured to the lip 16, the waste receptacle 16 extends underneath the portable toilet seat 10 below the center, capable of capturing human waste deposited therein.

Figure 2:
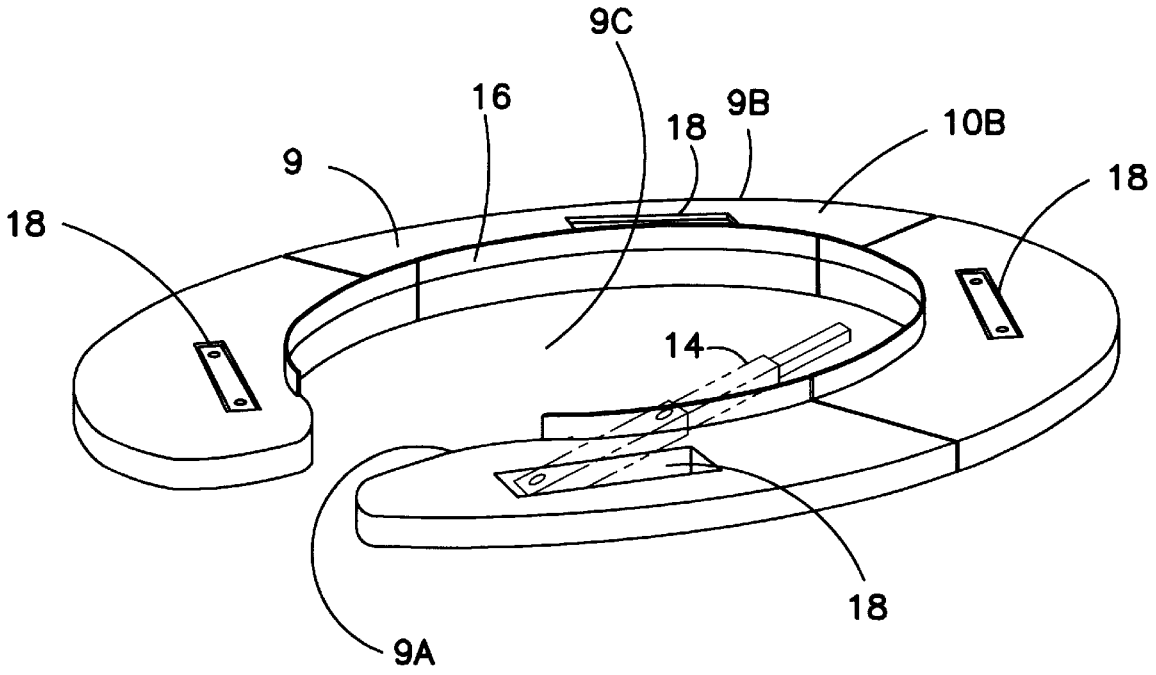
FIG. 2 illustrates the portable toilet seat with the telescoping legs retracted.
Figure 3:
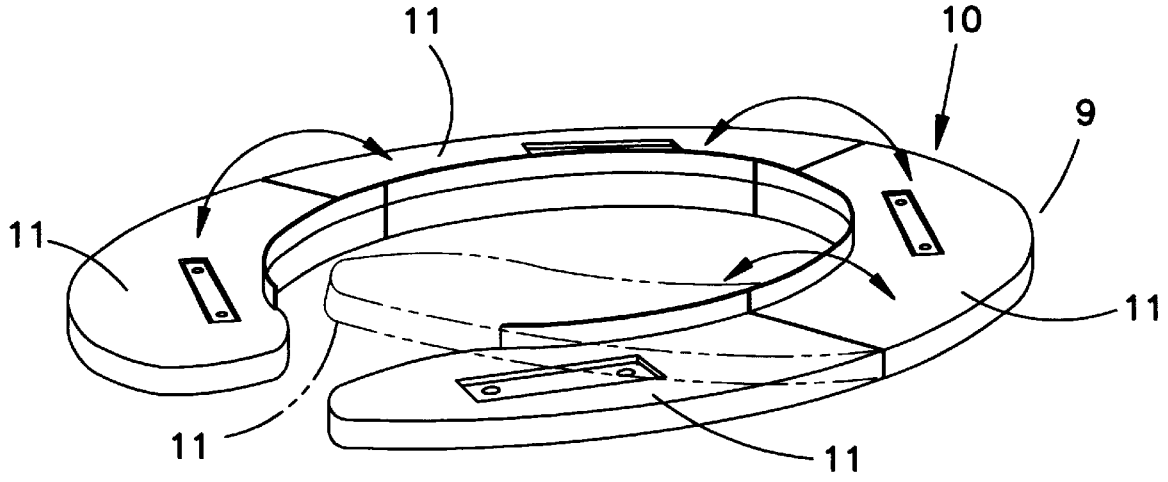
FIG. 3 illustrates the portable toilet seat being collapsed for convenient storage.
Figure 4:
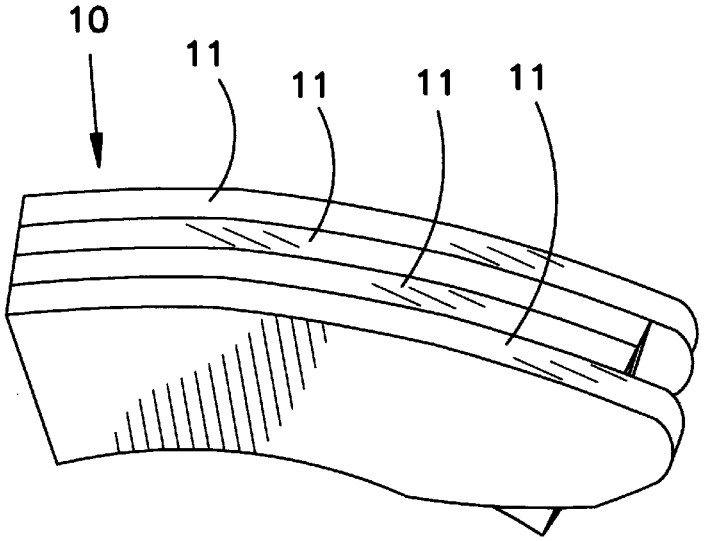
FIG. 4 depicts the portable toilet seat in a collapsed state.

A plurality of recesses 18 are disposed about the bottom surface 9B of the base 9. Said recesses 18 are sized to accept the collapsed telescoping legs 14 so that said telescoping legs 14 are contained flush therein as seen in FIG. 2, thus allowing the base 9 to be placed flat upon the toilet bowl 12 as shown in FIG. 1*b* when the user does not wish contact therewith. An optional splash guard 20 may be affixed to the front region 10F of the base 9 to prevent splashing of liquid human waste. Furthermore, the base 9 of the portable toilet seat 10 may consist of a plurality of hingeably joined base segments 11 to facilitate collapsing said portable toilet seat 10 for storage as seen in FIGS. 3 and 4.

What is claimed is:

1. A portable toilet seat comprising:

a) a base, horseshoe in shape like a conventional toilet seat, having an inner surface, an outer surface, a top surface, a bottom surface, a front region and an open center;

b) a plurality of telescoping legs extending downward from the bottom surface of the base, wherein said telescoping legs may be placed upon a surface such as the ground, thus supporting the base thereabove and allowing an individual to sanitarily and hygienically excrete waste through the open-center and wherein a plurality of recesses, one for each leg, are disposed about the bottom surface of the base, said recesses sized to accept and contain the telescoping legs flush therein when said legs have been collapsed, whereby the base of the portable toilet seat may be placed flush upon an existing toilet bowl to prevent bodily contact with the bowl during use thereof.

2. The portable toilet seat of claim 1, wherein a lip extends downward about the perimeter of the inner surface, said lip capable of engaging a deformable waste receptacle for capturing, containing and sanitarily disposing of human waste deposited into said waste receptacle.

3. The portable toilet seat of claim 2, wherein a splash guard is affixed to the front region of the base to prevent the splash of human liquid waste.

4. The portable toilet seat of claim 2, wherein the base of said portable toilet bowl seat consists of a plurality of hingeably attached base segments, whereby the portable toilet seat may be conveniently collapsed for storage and transport.

5. The portable toilet seat of claim 4, wherein a splash guard is affixed to the front region of the base to prevent the splash of human liquid waste.

* * * * *